US007827647B2

(12) United States Patent
Good

(10) Patent No.: US 7,827,647 B2
(45) Date of Patent: Nov. 9, 2010

(54) AUTOMATIC TUBE/CONDUIT CLEANING SYSTEM

(76) Inventor: Brian Good, 30 Essex La., Trumbull, CT (US) 06611

( * ) Notice: Subject to any disclaimer, the term of this patent is extended or adjusted under 35 U.S.C. 154(b) by 19 days.

(21) Appl. No.: 12/284,563

(22) Filed: Sep. 23, 2008

(65) Prior Publication Data

US 2009/0031514 A1 Feb. 5, 2009

Related U.S. Application Data

(63) Continuation of application No. 12/008,052, filed on Jan. 8, 2008, now abandoned, which is a continuation of application No. 10/773,661, filed on Feb. 6, 2004, now abandoned.

(60) Provisional application No. 60/447,044, filed on Feb. 10, 2003.

(51) Int. Cl.
*B08B 1/00* (2006.01)

(52) U.S. Cl. ..... 15/104.095; 15/104.09

(58) Field of Classification Search ..... 15/104.09, 15/104.095, 104.11, 24, 104.2; 74/606 R
See application file for complete search history.

(56) References Cited

U.S. PATENT DOCUMENTS 5,235,718 A * 8/1993 Grimsley et al. ..... 15/104.095
5,636,403 A * 6/1997 Grimsley et al. ..... 15/104.095

* cited by examiner

*Primary Examiner*—Laura C Guidotti

(57) ABSTRACT

By providing a gear assembly employing drive gears which engage at least two associated gears for simultaneous rotation, with the gear assembly being constructed for axially driving the bush-bearing shaft/cable member, a new fully automatic, portable tube/conduit cleaning system is attached, with the components forming the system being capable of being easily held and carried to any desired job site. By employing this construction, the cleaning system of the present invention enables the shaft/cable carrying the rotating brush to be driven in both a forward and reverse direction, along the axis of the tube or conduit, making it easier for an operator to clean extremely difficult pipes and conduits, while also controlling the relative speed of the brush rotation. In the present invention, the elongated flexible shaft/cable is controllably fed at a low rate of speed, while the cleaning brush is rotated at a relative very high rate of speed, thereby achieving superior cleaning results.

17 Claims, 9 Drawing Sheets

AUTOMATIC TUBE/CONDUIT CLEANING SYSTEM

RELATED APPLICATIONS

This application is a Continuation Application of U.S. Ser. No. 12/008,052 filed Jan. 8, 2008 now abandoned entitled AUTOMATIC TUBE/CONDUIT CLEANING SYSTEM which is a Continuation Application of U.S. Ser. No. 10/773,661, filed Feb. 6, 2004 now abandoned entitled AUTOMATIC TUBE/CONDUIT CLEANING SYSTEM which is related to U.S. Provisional Patent Application Ser. No. 60/447,044, filed Feb. 10, 2003 entitled AUTOMATIC TUBE/CONDUIT CLEANING SYSTEM.

TECHNICAL FIELD

This invention relates to automatic tube/conduit cleaning systems and, more particularly, to an automatic tube/conduit cleaning system which is completely portable and provides improved control and cleaning capabilities by the user.

BACKGROUND ART

It is well known that a wide variety of equipment and machines, such as are found in power plants and large-scale boilers, incorporate a plurality of elongated tubes or conduits which become coated with unwanted particulate matter, such as soot, dirt, grease, scale, etc. Since these deposits frequently interfere with the efficient operation of the equipment, the elongated tubes or conduits must be cleaned. However, due to the axial length of each of the conduits, as well as the large number of conduits that typically exist in a single installation, cleaning of this equipment is not easily achieved.

In order to satisfy this need, a wide variety of tube cleaning equipment has been developed. Typically, these commercially available tube cleaning systems incorporate a rotating brush, mounted on the end of an elongated cable, with the cable being capable of being advanced into and out of the elongated tubes/conduits, in order to provide the desired cleaning. However, although such systems are presently available, it has been found that the systems are incapable of satisfying all of the needs and demands required by the equipment user as well as the consumers.

In particular, prior art cleaning equipment is typically bulky and difficult to transport easily and conveniently. As a result, users are required to move heavy components into the desired locations, in order to employ these prior art products.

Furthermore, prior art constructions suffer from several drawbacks and disadvantages in the construction and operation of the products. In this regard, axial movement of the rotating cable through the conduits to be cleaned is often difficult and requires multiple passes in order to obtain the desired cleaning. In addition, the control over the axial movement of the rotating cable to which the rotating brush is mounted is dependent upon a single drive shaft which causes a plurality of drive rollers to be sequentially rotated. Consequently, damage to any drive roller can effectively eliminate the ability of the shaft to achieve the desired rotation and, thereby, the desired axial movement of the cable. In addition, these prior art systems typically employ drive belts for rotating the rollers, thereby further increasing operational difficulties and breakdowns.

A further problem commonly found in prior art constructions is the tendency of these prior art products to start with the equipment rapidly moving from stand still to full operational speed. As a result, manual control and handling of the equipment during the startup process is often difficult and potentially harmful to the users.

Therefore, it is a principal object of the present invention to provide a fully automatic, tube/conduit cleaning system which is completely portable and is easily held and carried to any desired job site or location.

Another object of the present invention is to provide a fully automatic, tube/conduit cleaning system having the characteristic features described above wherein the axial movement of the cable and/or the rotational movement of the brush are fully controlled by the operator with the speeds thereof being variable.

Another object of the present invention is to provide a fully automatic, tube/conduit cleaning system having the characteristic features described above wherein the rotational speed of the brush is controlled for being substantially greater than the speed at which the cable longitudinally moves, thereby providing improved control and cleaning capabilities.

Another object of the present invention is to provide a fully automatic, tube/conduit cleaning system having the characteristic features described above wherein system startup is controlled for providing a gentle ramp-up to full operational speed for enabling the user to easily control the overall system.

Another object to the present invention is to provide a fully automatic, tube/conduit cleaning system having the characteristic features described above wherein the axial movement of the cable is controlled by a plurality of drive rollers which are substantially independent of each other, for assuring long-term, continuous operation.

Other and more specific objects will in part be obvious and will in part appear hereinafter.

SUMMARY OF THE INVENTION

By employing the present invention, all of the difficulties and drawbacks found in the prior art systems have been completely overcome and a new, unique, fully automatic tube/conduit cleaning system is attained. In the present invention, the automatic cleaning system is completely portable, with the components forming the system being capable of being easily held and carried to any desired job site.

In addition, the cleaning system of the present invention enables the cable carrying the rotating brush to be driven in both a forward and reverse direction, along the axis of the tube or conduit, thereby making it easier for an operator to clean extremely difficult pipes and conduits, such as found in desalination tanks. Furthermore, the present invention is constructed for feeding the elongated flexible shaft at a low rate of speed, while allowing the cleaning brush to be rotated at a very high rate of speed. In this way, superior cleaning results are achieved.

A further additional feature incorporated into the tube cleaning system of the present invention includes a variable speed control assembly which enables the operator to control the cable feed rate as well as the tube rotation rate. In this way, the operator is able to attain improved scrubbing results on more difficult tubes and conduits. In addition, the present invention incorporates an assembly for directly controlling the shaft rotation, water flow, and/reverse rotation through an air switch mechanism. As a result, direct operator control over all important system operations is easily achieved.

A further feature incorporated into the cleaning system of the present invention is a soft start capability which allows the rotation of the shaft, as well as the axial advance of the shaft to be ramped up at a continuous rate, as opposed to prior art systems which transition from no rotation to full rotation. By employing the soft start capabilities of the present invention, the operator is able to easily control the operation of the system and enjoy a more comfortable, operation.

A further feature incorporated into the cleaning system of the present invention is a unique construction employed for assuring trouble-free movement of the elongated cable through the drive system of the present invention. In this regard, a spring bias, axially movable, portal bearing plate member is mounted to the housing of the cleaning system of the present invention, with the elongated cable being constructed for axial movement through the portal of the plate member.

By constructing the plate member to be spring biased outwardly, while being movable relative to the side surface of the housing for being controlled between Wits various travel distances relative thereto, the elongated flexible cable shaft is able to slide freely through the portal plate, completely eliminating binding, locking, or unwanted axial stoppage.

The invention accordingly comprises the features of construction, combination of elements and arrangements of parts which will be exemplified in the construction hereinafter set forth, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1-10 along with the following detailed discussion, the construction and operation of the preferred embodiment of cleaning system 20 of the present invention can best be understood. Although this disclosure fully and completely details the preferred embodiment of the present invention, variations of this invention may be made without departing from the scope of this invention. Consequently, it is to be understood that FIGS. 1-8 and the following discussion are provided for exemplary purposes only and are not intended as a limitation of the present invention.

Figure 1:
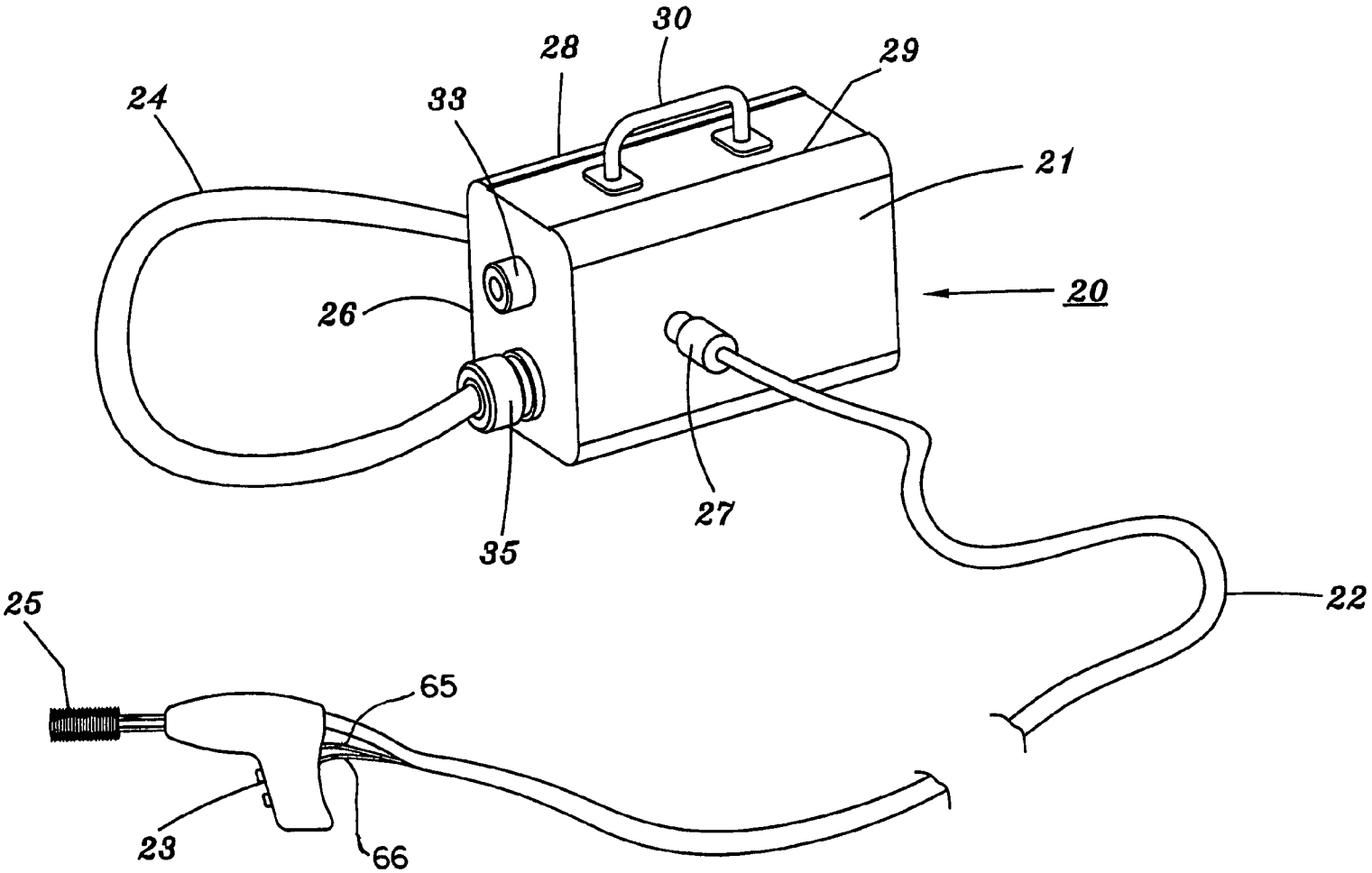
FIG. 1 is a perspective view of the cleaning system of the present invention.
Figure 2:
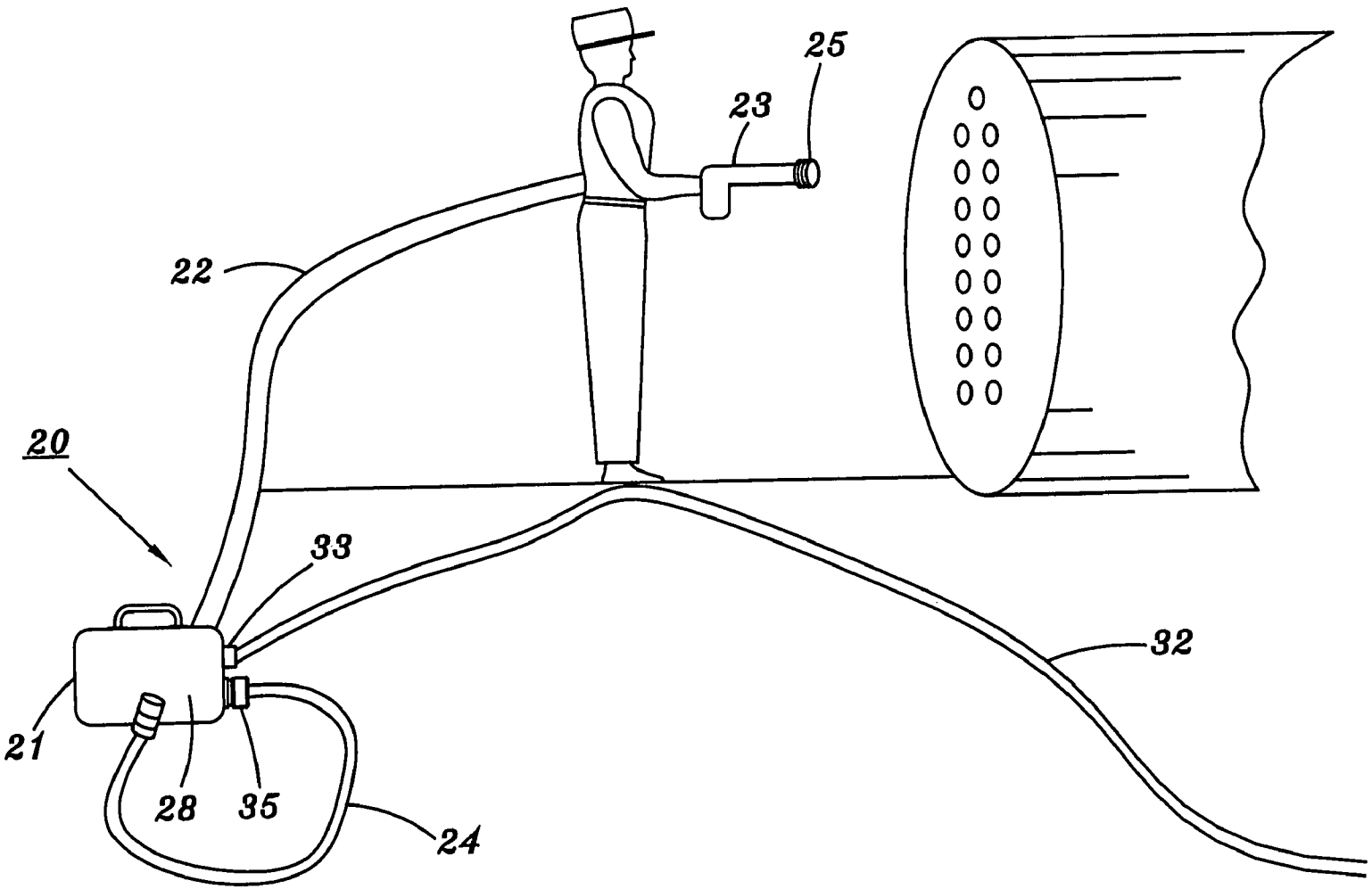
FIG. 2 is a diagrammatic view of the cleaning system of the present invention in use.

As shown in FIGS. 1 and 2, tube/conduit cleaning system 20 of the present invention principally incorporates housing 21, elongated delivery tube 22, control handle 23, an elongated flexible shaft or cable 24 and brush 25. Typically, brush 25 is affixed to the distal end of flexible shaft/cable 24 for controlled movement therewith, while being supported, in its initial position, at the end of handle 23. In the preferred construction of the present invention, housing 21 incorporates front panel 26, side panels 27 and 28, top panel 29 and handle 30 mounted to top panel 29.

As is fully detailed below, housing 21 incorporates all of the control equipment required for achieving the desired operation of cleaning system 20, with all of this control equipment being contained in a small, compact unit. As a result, the incorporation of handle 30 on top panel 29 enables the operator to easily transport cleaning system 20 to any desired jobsite, in a convenient and expeditious manner.

As shown in FIGS. 1 and 2, delivery tube 22 is mounted at one end to panel 27 and, at its opposed end, is connected with control handle 23. In addition, delivery tube 22 is constructed for containing an elongated length of shaft/cable 24 therein, with cleaning brush 25 mounted to the end of shaft/cable 24 and supported by handle 23. In addition, delivery tube 22 is constructed for receiving and channeling a continuous supply of water, when required, in order to assist in the cleaning operation. In this regard, a water supply line 32 is mounted to receiving port 33 formed on front panel 26 of housing 21 for providing the required water.

As is more fully detailed below, flexible shaft/cable 24 comprises a continuous, substantially elongated length, which is diagrammatically represented in FIGS. 1 and 2. In general, flexible shaft/cable 24 must comprise a sufficient length which enables shaft/cable 24 to extend from front panel 26 of housing 21 into side panels 28, out through side panel 27 into delivery tube 22 and through control handle 23. In addition, flexible shaft/cable 24 must also have a sufficient length which enables the shaft to extend into and through the entire length of tube/conduit which is being cleaned, as diagrammatically depicted in FIG. 2.

As shown, flexible shaft/cable 24 is connected to front panel 26 of housing 21 by being mounted to manifold assembly 35. As is further detailed below, manifold assembly 35 is constructed for cooperating with flexible shaft/cable 24 for continuously rotating flexible shaft 24 throughout its entire length. In this regard, flexible shaft 24 is typically constructed with an outer sleeve within which a rotating metal shaft member is mounted for achieving the continuous rotation desired for rotating brush 25 and attaining the cleaning operation provided by the present invention.

Figure 7:
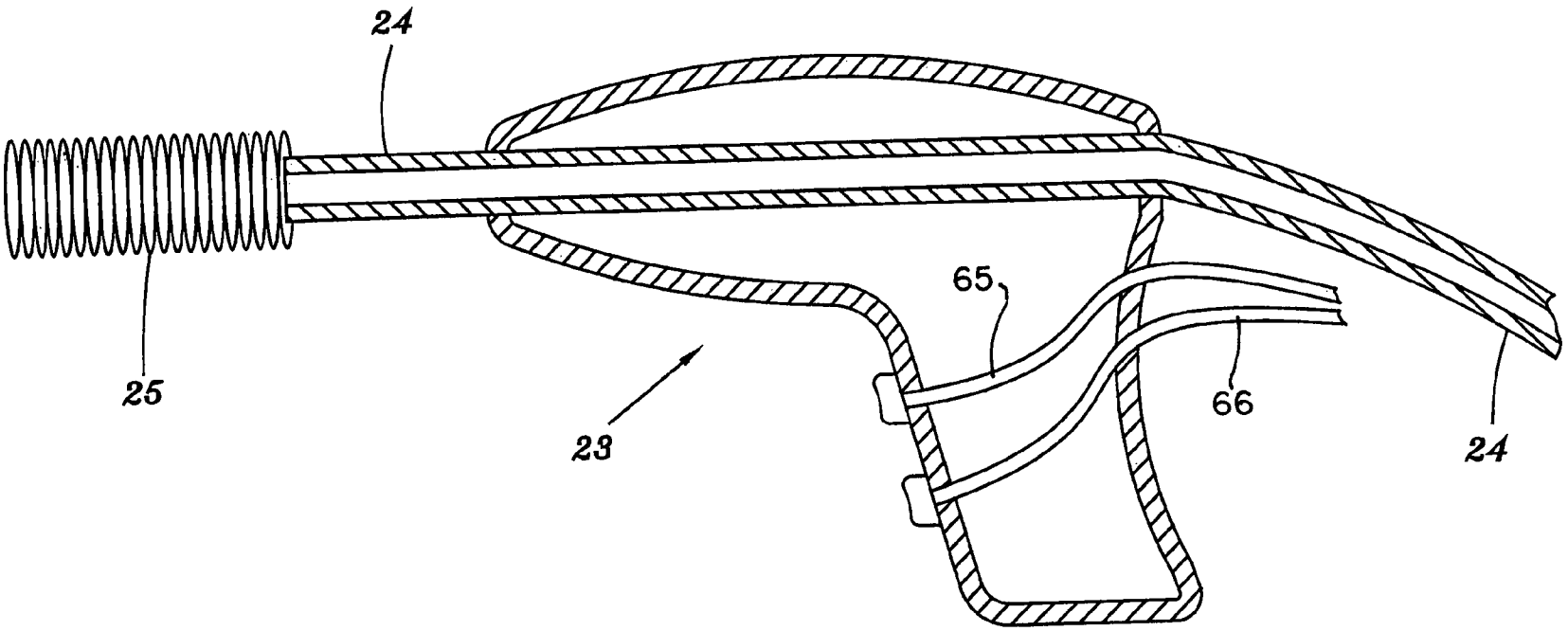
FIG. 7 is a diagrammatic view of the control handle of the cleaning system of the present invention.

In addition, as shown in FIGS. 1, 2, and 7, brush 25 is mounted at the distal end of flexible shaft/cable 24, connected directly to the internal metal shaft member for causing brush 25 to continuously rotate due to the rotation of the internal metal member within the sleeve of flexible shaft 24. In this way, the desired brush rotation is achieved and the cleaning of tubes/conduits is realized as rotating brush 25 is advanced through each tube/conduit during the typical operation.

In order to achieve the desired axial movement of brush 25 through each elongate tube/conduit to be cleaned, flexible shaft 24 is controllably moved longitudinally, either forwardly or rearwardly, at the control of the operator. In the preferred construction, air switches are mounted in housing 21 and are controlled by the user covering either air feed line 65 or 66 in order to control the movement of shaft/cable 24 in the desired direction.

In addition, Water continuously flows through delivery tube 22, along with the axial, longitudinal movement of flexible shaft 24. As a result, the cleaning of the desired tube/conduit is achieved by continuously rotating brush 25, axially advancing brush 25 and shaft 24 through the elongated length of each particular tube/conduit, while also simultaneously flushing the tube/conduit with water.

Although prior art systems operate in a substantially similar manner, these prior art systems are incapable of providing the requisite control over the axial rotation of brush 25 relative to the longitudinal movement of flexible shaft 24. In the present invention, the control system is constructed for providing optimum brush rotation relative to the axial movement of shaft 24. In addition, by further providing a variable speed control assembly integrated into the electronics of the system, any desired rotation of brush 25 and axial shaft movement is capable of being realized. In this regard, it has been found that optimum results are attained by rotating brush 25 at a speed which is double the speed at which flexible shaft 24 is longitudinally moved.

Figure 3:
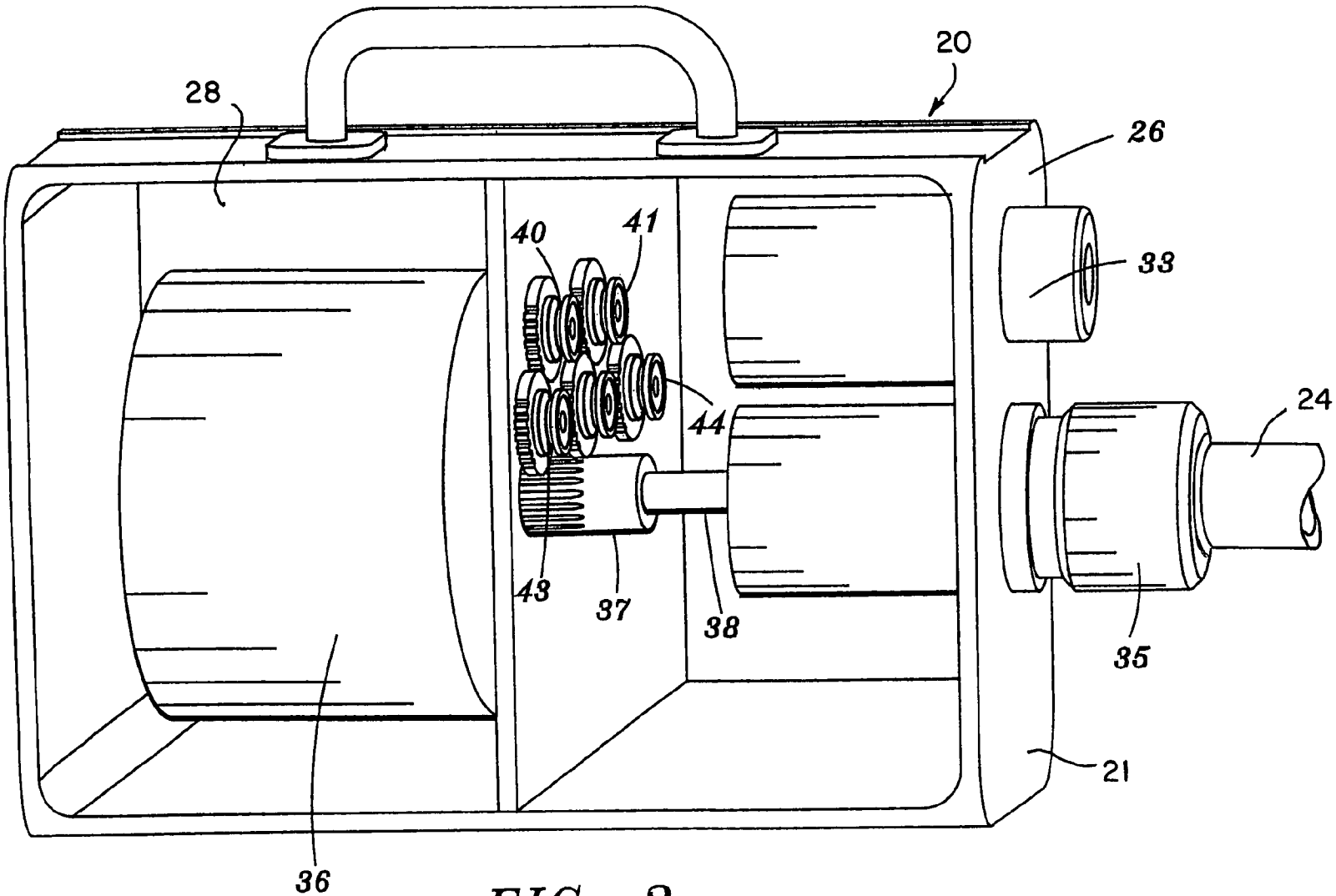
FIG. 3 is a side elevation view of the housing of the cleaning system with a side panel removed.

In order to best understand this unique control capability, reference should be made to FIG. 3, along with the following detailed discussion. In FIG. 3, housing 21, of cleaning system 20 is depicted with side panel 28 removed in order to enable the interior of housing 21 to be visible. As depicted, housing 21 of cleaning system 20 incorporates drive motor 36, the output of which is directly connected to drive gear 37 and shaft 38. Drive shaft 38 is directly connected to flexible shaft manifold assembly 35 for providing the desired continuous rotation of flexible shaft/cable 24 whenever shaft/cable 24 is mounted thereto.

Figure 4:
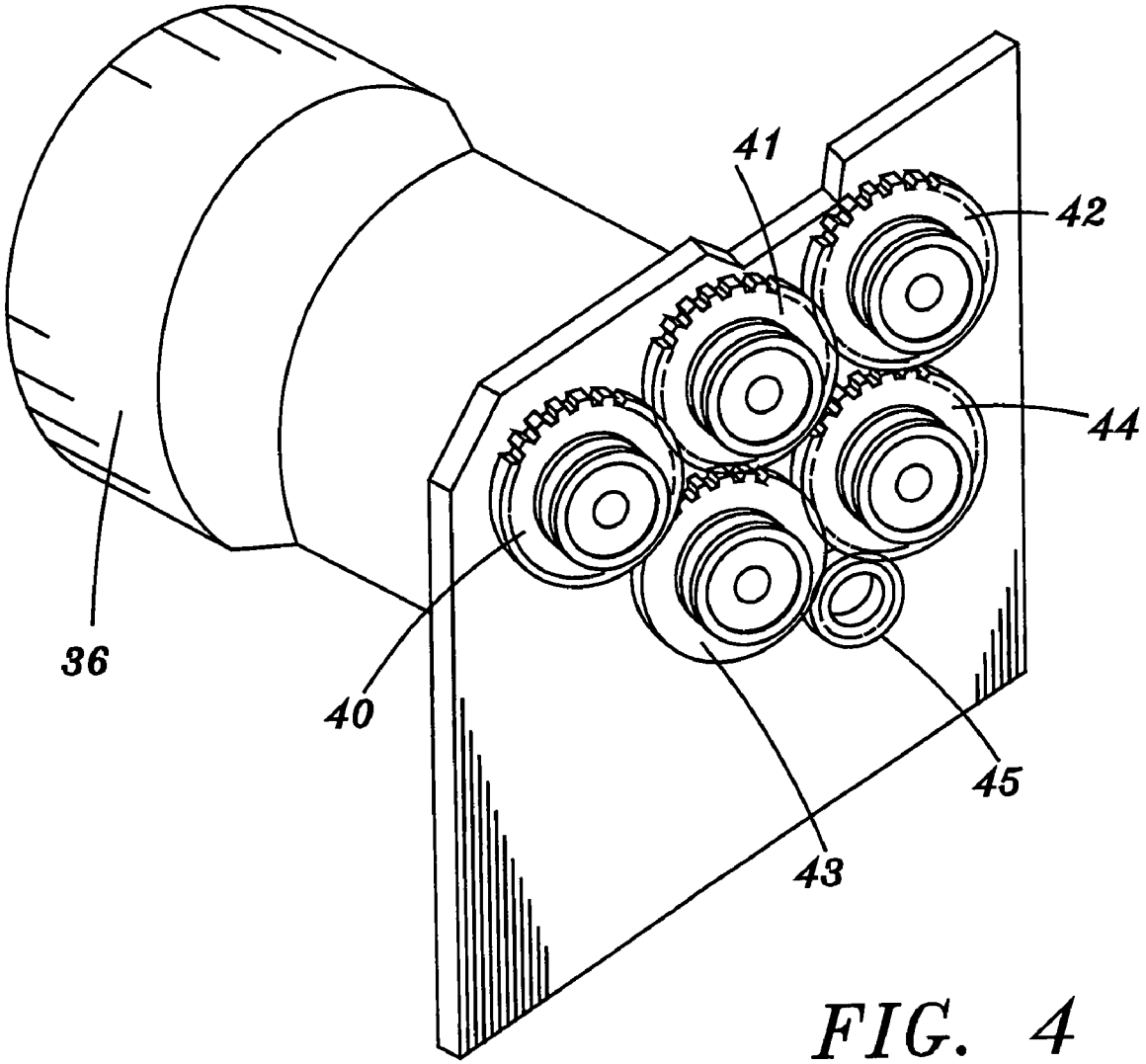
FIG. 4 is a perspective view of the drive motor and drive gears employed in the housing of the cleaning system of the present invention.
Figure 5:
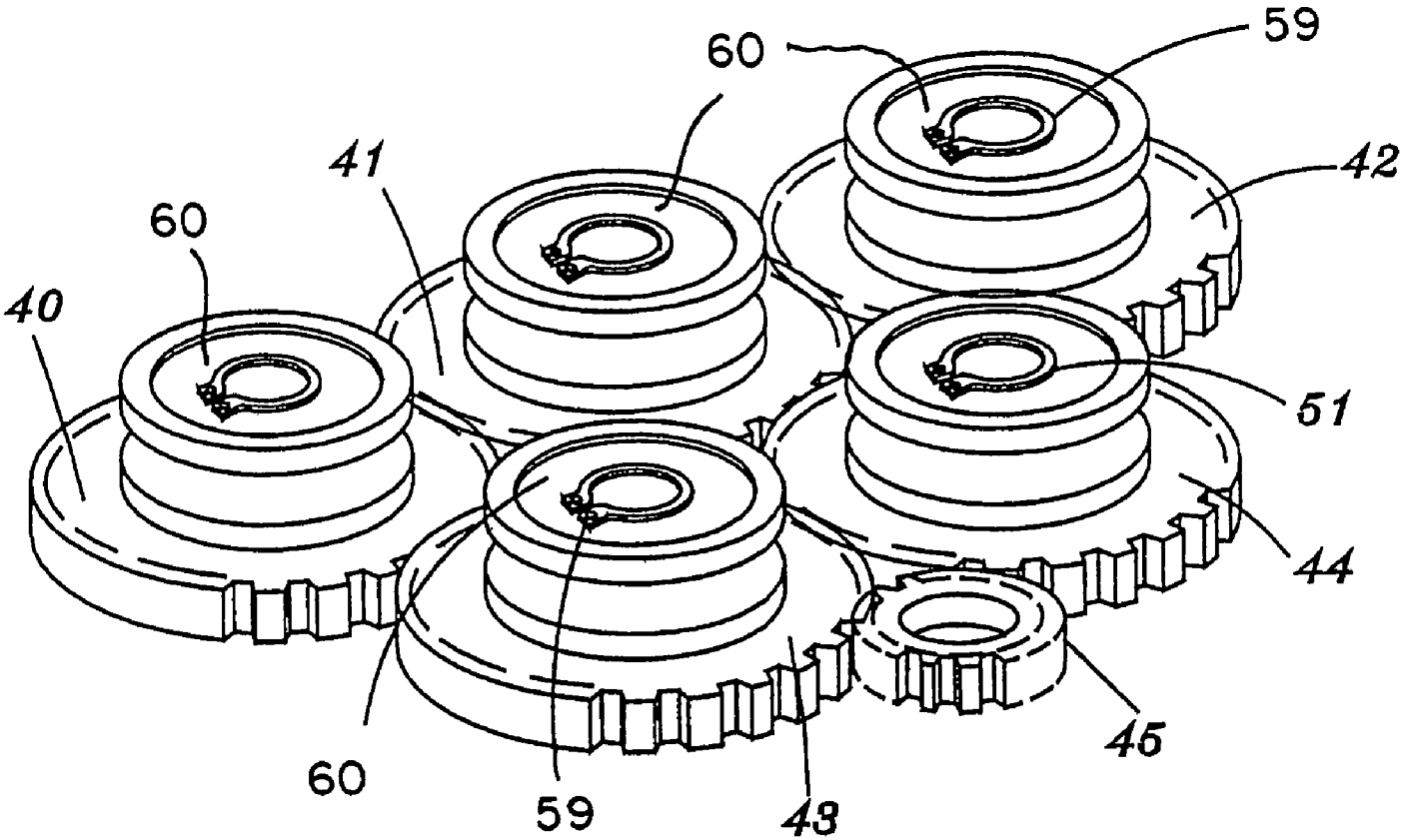
FIG. 5 is a front perspective view of the gear drive assembly employed in the cleaning system of the present invention, with the debris protective cover removed from one gear member.

In addition, as shown in FIGS. 3, 4, and 5, drive gear 37 and shaft 38 are drivingly engaged with pinion 45, which is directly connected to gears 40, 41, 42, 43 and 44. Pinion 45 and gears 40, 41, 42, 43, and 44 cooperate to form the drive system for controlling the axial movement of flexible shaft 24. As best seen in FIG. 5, pinion gear 45 is directly interconnected with gears 43 and 44 for causing gears 43 and 44 to rotate in the desired direction. In addition, gear 43 is controllably engaged with gears 40 and 41 for causing gears 40 and 41 to rotate in the desired direction, while gear 44 is connected to gears 41 and 42, for causing gears 41 in 42 to rotate as desired. In the preferred embodiment, all of the drive engaging gear teeth of each gear member and pinion are specially designed and configured to assure that the rotational movement of each gear member 40, 41, 42, 43, and 44 are in the precisely desired rotational direction for axially moving shaft/cable 24 in the desired direction.

In order to maintain the desired 2:1 ratio between the rotational speed of brush 25 relative to the longitudinal travel speed of shaft/cable 24, a gear reduction configuration is incorporated into drive gear 37, shaft 38, and/or the associated gear members 40, 41, 42, 43, and 44. In this way, regardless of the controls imposed on the system by the operator, the rotational speed of brush 25 is maintained at about double the longitudinal travel speed of shaft/cable 24.

By employing this construction, the rotational movement of pinion gear 45 independently controllably connects to two other gear members, namely gear 43 and 44, for providing the desired rotational movement thereof in the desired rotational direction, with gears 43 and 44 directly driving the remaining gear members of the gear system. As a result, any damage that may be caused to one gear by the axial movement of shaft/cable 24 is incapable of preventing the remaining gears from operating in their normal manner, due to the redundancy provided in the driving system of the present invention.

As discussed above, prior art systems typically employ gear members which are sequentially engaged with each other for obtaining their rotational movement. As result, any damage caused to one gear member, particularly the lead gear member, effectively prevents any subsequent gear member from rotating. However, by employing the present invention, this prior art difficulty is completely eliminated.

In view of the fact that flexible shaft/cable 24 operates in an extremely difficult environment, with the debris being cleaned from the conduits/tubes continuously adhering to the outer surface of shaft/cable 24 and passing through the drive gear members, damage to the gear members can occur. In the prior art systems, such damage can effectively prevent the movement of the shaft/cable, due to the inability of the gear members to rotate as required for axially driving the shaft/cable of the system. However, due to the construction detailed above and employed in the present invention, damage to a single gear member has virtually no effect on the overall operation of the system, with the desired axial movement of shaft/cable 24 continuing without any difficulty.

In the preferred embodiment, pinion gear 45 and gears 40, 41, 42, 43, and 44, are all constructed for being rotationally driven in a cooperating manner, with the rotational directions and gear ratio provided thereby specifically constructed to control the axial movement rate of shaft/cable 24 relative to the rotation rate being delivered to flexible shaft 24 through manifold assembly 35. As a result, the precisely desired ratio for the rotation of flexible shaft 24 and brush 25 relative to the longitudinal movement of flexible shaft 24 through each tube/conduit is precisely controlled as detailed above, with a 2:1 ration has been optimum.

Figure 6:
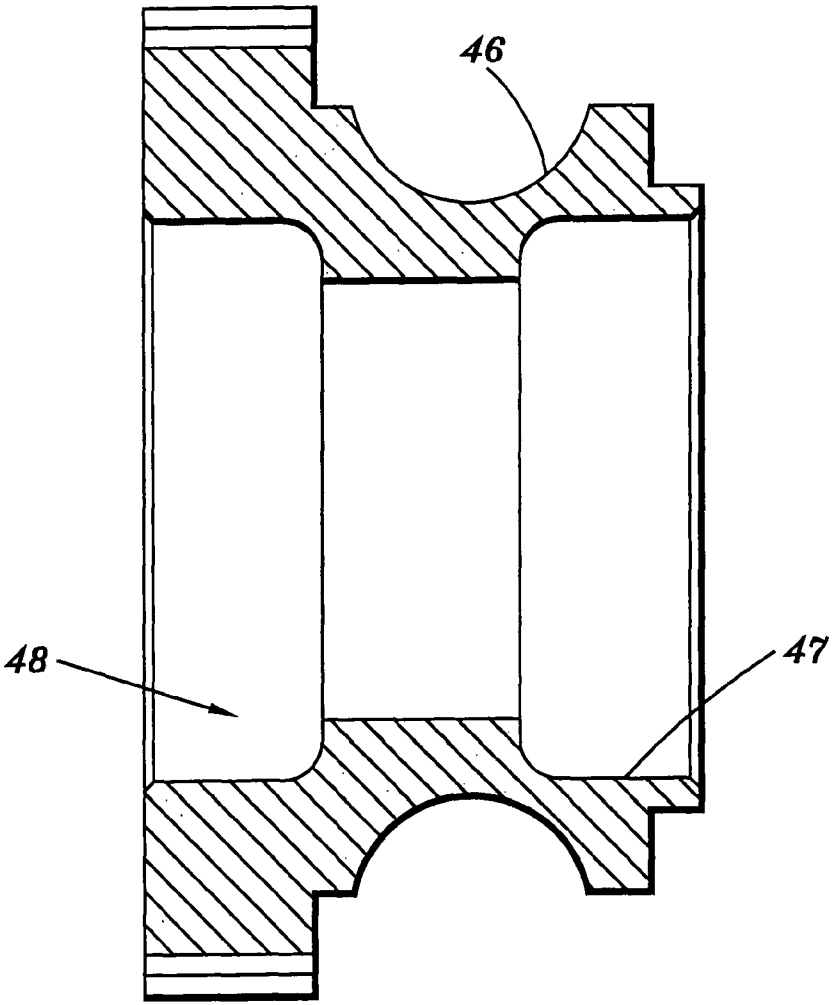
FIG. 6 is a cross-sectional side elevation view of the one gear member with the bearings removed.

Furthermore, as best seen in FIGS. 4, 5, and 6, secure, controlled, axial movement of flexible shaft 24 is provided by passing a length of flexible shaft 24 through each of the gear members 40, 41, 42, 43, and 44 in the serpentine or sinusoidal shaped travel path created thereby. By employing this preferred construction, the desired control over the axial movement of flexible shaft 24 is attained, without fear of slippage or unwanted stoppage of movement. Furthermore, by employing this serpentine or sinusoidal travel path, complete and dependable control over the forward and reverse movement of flexible shaft 24 is attained.

Each gear member 40, 41, 42, 43, and 44 are substantially identical in their overall construction, as generally represented in FIG. 6. In this regard, each gear member incorporates a concave curved outer surface 46 which is dimensioned for peripherally surrounding and embracing the outer surface of shaft/cable 24. In the preferred embodiment, the curvature of surface of 46 is constructed to assure secure gripping and contacted engagement with the outer surface of shaft/cable 24, while also providing continuous axial movement of shaft/cable 24 along surface 46 of the each gear member.

In addition, in the preferred embodiment, each gear member incorporates an interior housing 47 formed in the forward end thereof an housing of 48 formed in the rear end thereof. As shown in FIG. 5, ball bearing assemblies 49 are mounted in housings 47 and 48 in order to assure that each gear member is able to rotationally move about its central axis with complete freedom.

Furthermore, as depicted, in FIG. 5, ball bearing assemblies 49 are secured in position about the shaft by locking washer 59. Finally, in order to prevent unwanted damage from occurring to ball bearing assemblies 49, cover 60 is mounted about the terminating end of each gear member to protect bearing assemblies 49 and the remaining elements contained therein. By employing this construction, assurance is provided that trouble-free rotational movement of each gear member is realized and the debris circulating through the gear members will not adversely affect the operation thereof.

Figure 8:
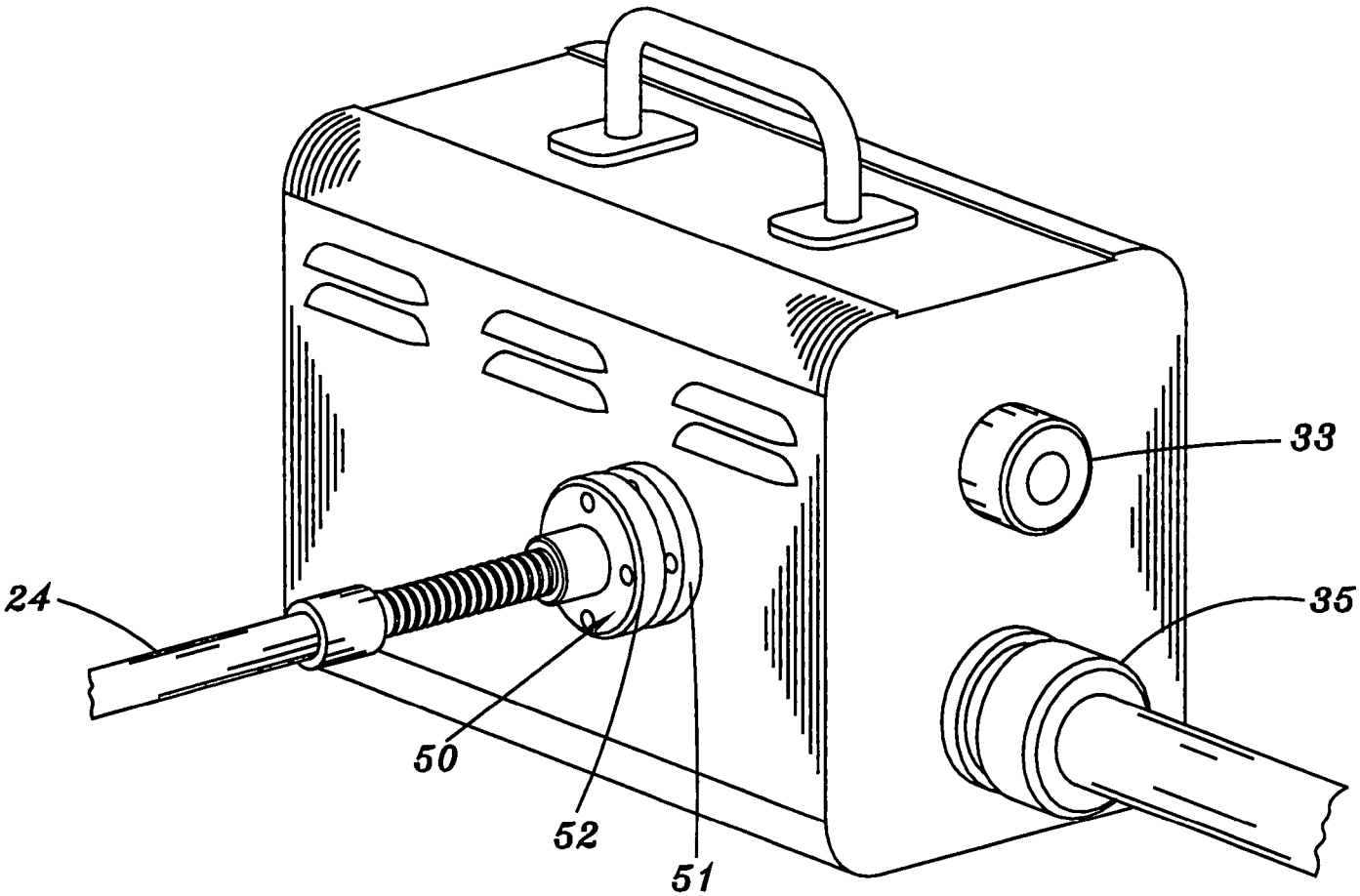
FIG. 8 is a perspective view of the housing of the cleaning system of the present invention with the drive shaft mounted thereto.
Figure 10:
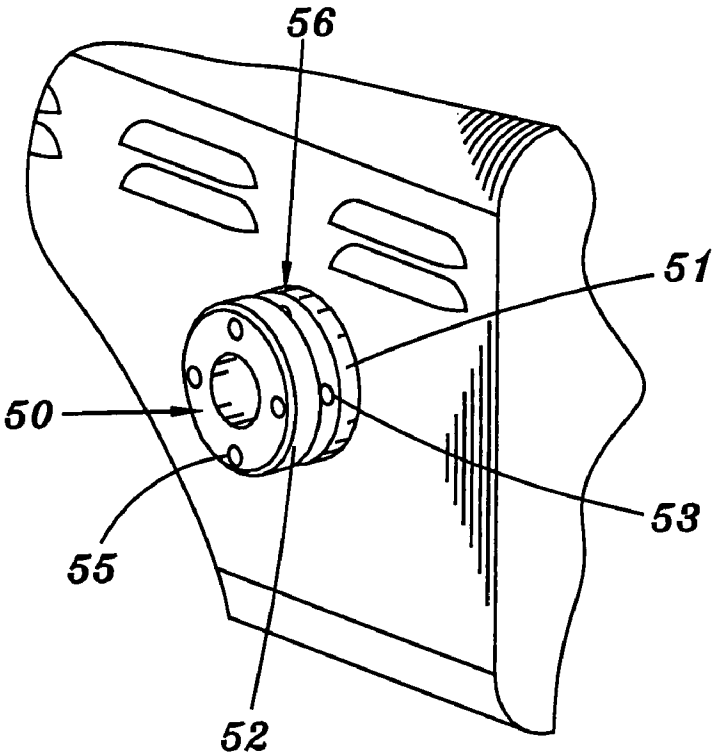
FIG. 10 is a perspective view of the housing of the cleaning system of the present invention with the flexible shaft removed.
Figure 9:
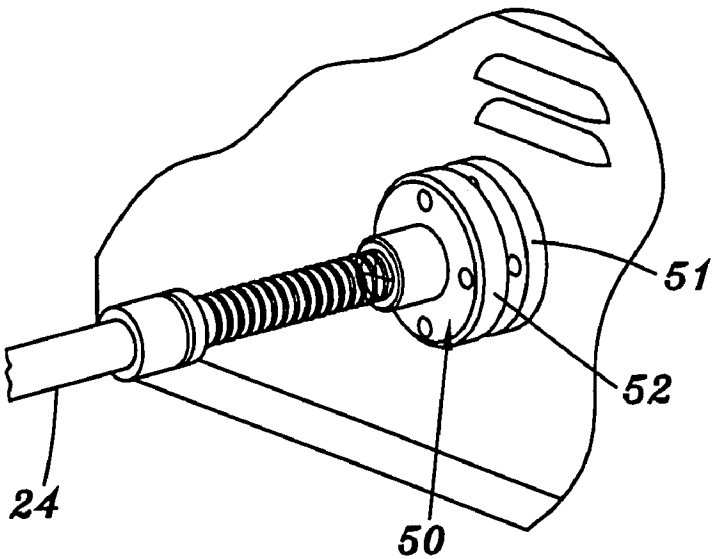
FIG. 9 is a perspective view of the housing of the cleaning system of the present invention with the drive shaft mounted thereto.

A final feature of the present invention is fully depicted in FIGS. 8-10. As detailed herein, this feature provides assurance that flexible shaft 24 advances through housing 21 smoothly and freely without any binding or stoppages.

In order to achieve the desired free movement of shaft 24 relative to side panel 28 of housing 21, movable plate assembly 50 is mounted about the shaft receiving hole formed in panel 28. In its preferred construction, plate assembly 50 comprises a base member 51 and a movable member 52 which is mounted to base member 51 by a plurality of legs, about which springs 53 are affixed.

With springs 53 mounted in compression, movable member 52 is continuously urged away from base member 51. In addition, movable member 52 may be advanced towards base member 51 whenever a force is received which overcomes the spring force, while stop surface 56 provides a fixed movement termination position.

As shown, both movable member 52 and base member 51 incorporate an aperture 55, through which flexible shaft 24 passes. As a result, as flexible shaft 24 is a axially advanced through housing 21, shaft 24 passes through apertures 55 of movable member 52 and base member 51.

Due to the elongated length of flexible shaft 24 and the axial speed at which shaft 24 moves, shaft 24 is drawn through apertures 55 of movable plate 52 at virtually any angle relative to the central axis of aperture 55. In prior art systems, the entry of shaft 24 into the receiving hole often causes binding or stoppage of the shaft's movement due to the inability of shaft 24 to handle the angular bend. However, by employing movable plate assembly 50 of the present invention, this problem is eliminated.

In the present invention, any sharp angular change or transition causes movable plate 52 to flex relative to base member 51. As a result, a sharp angular bend is eliminated, and shaft 24 is able to freely move through aperture 55. In this way, the prior art inabilities are eliminated, and a smooth, trouble-free shaft movement system is attained.

It will thus be seen that the objections set forth above, among those made apparent from the preceding description, are efficiently attained and, since certain changes may be made in the above construction without departing from the scope of the invention, it is intended that all matter contained in the above description or shown in the accompanying drawings-shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A light-weight, portable, cleaning system for providing efficient cleaning of elongated tubes or conduits, said system comprising:

A. a single housing for retaining components forming the system said housing incorporating an interior support wall mounted therein;

B. an elongated, continuous shaft/cable;

C. a brush mounted to a first end of the elongated shaft/cable;

D. a single motor mounted in the housing to a first surface of the support wall and constructed for rotationally driving a drive shaft associated therewith at a first rotational speed, said drive shaft extending through said support wall and being directly drivingly engaged with a coupling, said coupling connected to the elongated shaft/cable for continuously rotating said shaft/cable at said first rotational speed;

E. a pinion gear mounted to a second surface of the support wall and drivingly engaged directly with the drive shaft of the motor and interconnected with a plurality of gear members for imparting rotational movement to the gear members in order to achieve the desired axial movement of the shaft/cable; and F. said plurality of gear members mounted in the housing to the second surface of the support wall adjacent the pinion gear;

a. rotationally mounted in juxtaposed, side to side relationship and cooperating to define a travel path for receiving a length of the shaft/cable and longitudinally driving the shaft/cable in either a forward direction or a rearward direction; and b. said gear members being constructed for receiving the rotation of the pinion gear at the first rotational speed and effectively producing a substantially reduced rotation at a second rotation speed, whereby controlled axial movement and rotational movement of the shaft/cable is attained in an efficient and controlled manner, with the rotational speed of the shaft/cable and the brush mounted thereto, being substantially greater than the axial/longitudinal movement speed of the shaft/cable.

2. The cleaning system defined in claim 1, wherein the plurality of gear members are further defined as comprising five separate and independent gear members, with three of said gear members being aligned in a first row and two of said gear members being aligned in a second, adjacent row.

3. The cleaning system defined in claim 2, wherein each of the gear members mounted in said second row are interconnected with the gear members mounted in the first row for rotationally driving at least two of said gear members.

4. The cleaning system defined in claim 3, wherein the pinion gear is further defined as being mounted in driving engagement with the two gear members mounted in said second row, whereby the rotational movement of the pinion gear imparts the driving force for rotating all of the gear members.

5. The cleaning system defined in claim 1, wherein each gear member is further defined as being rotationally mounted on a support shaft with each of said support shafts being mounted to said support wall in juxtaposed, spaced, aligned relationship with each other.

6. The cleaning system defined in claim 5, wherein each gear member is further defined as comprising a concave outer surface portion constructed for receiving and controllably advancing the shaft/cable mounted therewith to provide the desired axial movement of said shaft/cable.

7. The cleaning system defined in claim 1, wherein said system further comprises a handle mounted to the second end of the shaft/cable for enabling the operator to position the brush and rotating shaft/cable where desired, said handle further comprising control means for selecting the directional movement of the shaft/cable.

8. The cleaning systems defined in claim 7, wherein said control means is further defined as comprising a pair of air feed lines mounted in said handle, said air feed lines being constructed for controlling the direction of movement of the shaft/cable by opening or closing said feed lines.

9. The cleaning system defined in claim 1, wherein the rotational output of the motor is further defined as being interconnected with a gear reducing assembly for controllably reducing the rotational speed of the gear members relative to the rotational speed of the shaft/cable, thereby assuring that the rotational speed of the shaft/cable is more rapid then the longitudinal movement speed of the shaft/cable.

10. The cleaning system defined in claim 1, wherein said system further comprises electronic controls for enabling system start-up to occur in a continuously increasing, power ramp-up manner.

11. A light-weight, portable, cleaning system for providing efficient cleaning of elongated tubes or conduits, said system comprising:

A. an elongated, continuous shaft/cable;

B. a brush mounted to a first end of the elongated shaft/cable;

C. a single motor constructed for rotationally driving a drive shaft associated therewith at a first, substantially continuous rotational speed, said drive shaft being directly drivingly engaged with a coupling, said coupling connected to the elongated shaft/cable for continuously rotating said shaft/cable at said first rotational speed;

D. a pinion gear drivingly engaged directly with the drive shaft the motor and interconnected with a plurality of gear members for imparting rotational movement to the gear members in order to achieve the desired axial movement of the shaft/cable; and E. said plurality of gear members;

a. rotationally mounted in juxtaposed, side to side relationship and cooperating to define a travel path for receiving a length of the shaft/cable and longitudinally driving the shaft/cable in either a forward direction or a rearward direction; and b. said gear members being constructed for receiving the rotation of the pinion gear at the first rotational speed and effectively producing a substantially reduced rotation at a second rotation speed, F. a housing constructed for retaining the motor, gear assembly, and associated electronics and enabling the cleaning system to be easily transported wherever desired;

G. a shaft/cable receiving portal formed in the housing in cooperating alignment with the travel path formed by the gear members for enabling the shaft/cable to move into and out of the housing depending upon the rotational movement of said gear members; and H. a spring biased shaft/cable movement control assembly mounted to the receiving portal formed in the housing and constructed for receiving the shaft/cable as the shaft/cable axially moves relative to the housing and controllably aligning the shaft/cable for movement relative to the receiving portal to prevent binding thereof;

whereby controlled axial movement and rotational movement of the shaft/cable is attained in an efficient and controlled manner, with the rotation of the shaft/cable being substantially greater than the axial movement speed thereof.

12. The cleaning system defined in claim 11, wherein said movement control assembly is further defined as comprising a first plate member and a second plate member mounted in juxtaposed, spaced, cooperating alignment with each other, with each of said plate members incorporating a hole positioned in axially alignment with each other for receiving and guiding the shaft/cable.

13. The cleaning system defined in claim 12, wherein the first plate member is further defined as being mounted directly to said housing with the receiving hole thereof aligned with the portal formed in the housing and the second plate member is movably mounted to the first plate member.

14. The cleaning system defined in claim 13, wherein said movement control assembly further comprises a plurality of spring members mounted between the first plate member and the second plate member for continuously biasing the second plate member away from the first plate member while enabling the second plate member to be moved towards the first plate member by the axial movement of the shaft/cable, thereby guiding and controlling the entry angle of the shaft/cable into the receiving portal of the housing for preventing binding thereof.

15. The cleaning system defined in claim 14, wherein said movement control member further comprises a plurality of guideposts extending from one plate member towards the other plate member for controlling the movement of the second plate member towards the first plate member.

16. A light-weight, portable, cleaning system for providing efficient cleaning of elongated tubes or conduits, said system comprising:

A. a single housing for retaining components forming the system said housing incorporating an interior support wall mounted therein;

B. an elongated, continuous shaft/cable;

C. a brush mounted to a first end of the elongated shaft/cable;

D. a single motor mounted in the housing to a first surface of the support wall and constructed for rotationally driving a drive shaft associated therewith at a first rotational speed; said drive shaft extending through said support wall and being directly drivingly engaged with a coupling, said coupling connected to the elongated shaft/cable for continuously rotating said shaft/cable at said first rotational speed;

E. a pinion gear mounted to a second surface of the support wall and drivingly engaged directly with the drive shaft of the motor and interconnected with a plurality of gear members for imparting rotational movement to the gear members in order to achieve the desired axial movement of the shaft/cable; and F. said plurality of gear members mounted in the housing to a second surface of the support wall adjacent the pinion gear;

a. rotationally mounted in juxtaposed, side to side relationship and cooperating to define a travel path for receiving a length of the shaft/cable and longitudinally driving the shaft/cable in either a forward direction or a rearward direction;

b. said gear members being constructed for receiving the rotation of the pinion gear at the first rotational speed and effectively producing a substantially reduced rotation at a second rotation speed, said second rotational speed representing the speed of the axial or longitudinal movement of the shaft/cable, and c. said first rotational speed being further defined as being about twice the second rotational speed.

17. The cleaning system defined in claim 16, wherein both the rotational speed of the shaft/cable and the longitudinal movement speed of the shaft/cable are controllable by the user.

* * * * *